United States Patent [19]

Nemec et al.

[11] Patent Number: 4,553,072

[45] Date of Patent: Nov. 12, 1985

[54] CIRCUIT CONNECTED IN SERIES WITH A DISCHARGE VALVE SOURCE

[75] Inventors: Frantisek Nemec; Petr Moos; Milan Bytesník; Jan Kuba; Tomislav Lacina, all of Prague, Czechoslovakia

[73] Assignee: Ceske vysoke uceni technicke v Praze, Prague, Czechoslovakia

[21] Appl. No.: 579,668

[22] Filed: Feb. 13, 1984

Related U.S. Application Data

[63] Continuation-in-part of Ser. No. 325,976, Nov. 30, 1981, abandoned.

[51] Int. Cl.[4] ..... H05B 37/00

[52] U.S. Cl. ..... 315/244; 315/243; 315/307

[58] Field of Search ..... 315/243, 244, 307

[56] References Cited

U.S. PATENT DOCUMENTS

| | | | |
|---|---|---|---|
| 2,417,742 | 3/1947 | Dosio | 315/243 |
| 2,708,251 | 5/1955 | Rively | 315/244 |
| 3,983,449 | 9/1976 | Dear et al. | 315/244 |
| 4,081,718 | 3/1978 | Kaneda | 315/244 |

*Primary Examiner*—Harold Dixon

[57] ABSTRACT

A circuit connected in series with a discharge valve source substantially reducing the current impulse in the course of starting the discharge valve, thereby prolonging its life and reducing the blackening of walls at the ignitor electrodes of the discharge valve.

4 Claims, 7 Drawing Figures

CIRCUIT CONNECTED IN SERIES WITH A DISCHARGE VALVE SOURCE

BACKGROUND OF THE INVENTION

This application is a continuation-in-part application of application Ser. No. 325,976 filed on Nov. 30, 1981, now abandoned.

This invention relates to an autoregulation circuit for use with a discharge valve source, in particular hydrogen or halogen discharge valves such as fluorescent lamps, neon lamps and the like.

Various circuits have been used to operate discharge valves. A choke coil with an external igniting device or transformer is usually used for this purpose. However, these circuits have known drawbacks. The use of a choke coil is expensive and external ignition using a thyristor circuit is complicated. Ignition devices with glow discharge lamps are not reliable. In general, the high starting current after switching on the discharge valve overloads the electrodes of the discharge valve and causes an ensuing reduction of the life of the electrodes. In addition, the luminous intensity of the discharge valve is reduced by these circuits since they cause a blackening of the burner which in turn reduces the working current and dynamic resistance of the discharge valve.

Transformer circuits fulfill the igniting and limiting functions required of a circuit connected in series with a discharge valve source. However, transformer circuits are expensive to build. Other electronic circuits are available, but are technically complicated, costly, and unreliable.

SUMMARY OF THE INVENTION

It is an object of this invention to provide a circuit connected in series with a discharge valve source which would eliminate these drawbacks, which would be reliable in operation and which would reduce the starting current of the discharge valve to values close to the nominal current in the course of operation of the discharge valve.

This invention relates to an autoregulation circuit operating on the principle of parametric resonance using an inductor-capacitor series-resonant circuit. The principle of such a circuit is shown in the accompanying FIG. 1.

The circuit shown in FIG. 1 allows a rise of voltage ($U_2$) in a discharge tube so as to maintain a constant current value during the life of the discharge tube. Thus, the voltage has to increase by a higher value than in the case of a circuit using a choke. This is achieved by the inductor-capacitor series-resonant circuit (RLC) wherein the resistor with a resistance $R_d$ does the choking.

It is known that a resonant circuit quality factor is proportional to the sensitivity of any variation in the choking resistance.

The voltage transfer function has the following form:

$$A(s) = \frac{U_2}{U_1} = K\frac{s^2 + \omega_2^2}{s^2 + \frac{1\omega_1}{Q}s + \omega_1^2}$$

wherein $$K = \frac{C_1}{C_1 + C_2}$$

$$\omega_2 = \frac{1}{LC_1}$$

$$\omega_1 = \frac{1}{L(C_1 + C_2)}$$

$$\frac{1}{Q} = \frac{1}{C_1 + C_2} \times \frac{1}{R_d}$$

On the basis of these equations, it is possible to obtain a diagram of amplitude frequency characteristics as shown in FIG. 2. Poles follow the trajectories of root hodographs as shown in FIG. 3.

Using optimalizing techniques, optimum values of the constants K, $\omega_1$ $\omega_2$ and Q were found in order to select optimum values for capacities $C_1$, $C_2$ and inductance L for halogen discharge tubes RVI-400 W.

The relative deviation in voltage $U_2$ depends upon the deviation of $R_d$ and can be written as $$\frac{\Delta U_2}{U_2} = \frac{U_2}{R_d} \cdot \frac{\Delta R_d}{R_d}$$

wherein $\int_{R_d}^{U_2}$ stands for the relative sensitivity of voltage $U_2$ to the relative variation of $R_d$. This sensitivity can be expressed in the form $$\frac{U_2}{R_d} = \frac{d\{A_u(s)U_1\}}{dR_d} \quad \frac{R_d}{A_u(s)U_1} = 1 - \frac{R_d}{L} \cdot \frac{1}{(s + \omega_1)}$$

which is valid for an orthodox series balast inductor.

However, for an inductor-capacitor series-resonant circuit (RLC) the equation has the form $$\frac{U_2}{R_d} = 1 - \frac{s^2(C_1 + C_2) + \frac{1}{L}}{s^2(C_1 + C_2) + \frac{s}{R_d} + \frac{1}{L}}$$

To optimalize the sensitivity, the value $j2\pi 60$ is substituted for s in the above equation since the real portion of this equation constitutes the sensitivity of amplitude characteristic at the point $p = j2\pi 60$. (See FIG. 4)

By comparing the sensitivity to empirically found values of $U_2$ rise during the aging of discharge tubes, initial conditions were obtained for optimalizing the circuit shown in FIG. 1.

Nomograms were prepared for the selection of values $C_1$ and $C_2$ for a particular discharge tube type.

In the circuit of this invention (FIGS. 1 and 6), a predetermined inductance L value was chosen based on the properties of discharge tubes RVI-400 W.

In the nomogram (FIG. 5) it is possible to read the magnitudes of $C_1$ and $C_2$ for various values L. (FIG. 5 refers to $C_2$ and $C_3$ which represent the corresponding elements in FIG. 6 which correspond respectively to $C_1$ and $C_2$ of FIG. 1) For other types of discharge tubes (or fluorescent lamps), it is necessary to ascertain the dependence of $R_d$ on the aging of the discharge tube, the corresponding increase in $U_2$ in the tube as well as the values of the determining parameters for maintaining a constant luminous intensity, or constant current in the discharge tube.

The values obtained by the optimalization of the circuit for RVI-400 W with a series-produced choke (inductance L=0.16H) are tabulated as follows:

| 1 choke | L | $C_1$ | $C_2$ |
|---|---|---|---|
| 2 RVI - 400 W | $4.35 \cdot 10^{-3} R_d^{-1}$ | $1.1 \cdot 10^{-4} R_d^{-1}$ | $0.3 \cdot 10^{-4} R_d^{-1}$ |

On the basis of the above relations and nomograms, it is possible to select values $C_1$, $C_2$ and L for discharge tubes or fluorescent lamps with a dynamic resistance $R_d$ within the range of 30–300 ohms.

An increase in the steepness of the dependence of $U_2$ on the resistance $R_d$ can be achieved by a reduction of $f_1$, which is accomplishhed by increasing the capacities of capacitors $C_1$ and $C_2$.

The present invention is a circuit (of the form shown in FIGS. 1 and 6) for current regulation based upon parametric resonance and can be used with high pressure as well as low pressure discharge tubes and fluorescent lamps. A feature of this series balast circuit wherein an inductor is series-connected to the discharge tube and a capacitor is parallel-connected to the power source, is that a resonant inductor-capacitor is parallel-connected to the inductor, and a resonant discharge capacitor is parallel-connected to the discharge tube. The capacity of said resonant inductor-capacitor may be from 0.1 to 10 times the capacity of said resonant discharge capacitor. The magnitude of inductance of the inductor and the magnitude of the capacity of the resonant inductor capacitor is determined by a resonance frequency within the range of from 30–150 Hz. Due to such a connection of the two capacitors, the operating current of the discharge tube is regulated to its nominal value.

The inductor circuit can comprise, optionally as shown in FIG. 6, a series connected build-up capacitor to reduce the build-up current of the discharge tube to values approaching the nominal current value. To the discharge tube there can also be connected in parallel an ignition capacitor and to the ignition capacitor can be connected in series a switch element such as thyristor. The discharge tube ignition is caused by an ignition voltage build-up by a resonance of the inductor and the ignition capacitor and initiated by said switch element. Optionally, a pick-up switch element can be connected in parallel to the discharge tube and a control switch element can be connected in parallel with the inductor. The switch elements can be relays or semiconductor switching elements. The contacts of said pick-up switch element are interconnected in series with the resonant discharge capacitor, in series with the control switch element, and in series with the pick-up switch element itself.

Connecting and disconnecting contacts of the control switch element are series connected with the pick-up switch element and simultaneously parallel connected with the contact of the pick-up switch element and, finally, series connected with the build-up capacitor. The switch over contact of the control switch element is series connected to the inductor. The connection of these switch elements optimalizes the operation sequence of the individual elements of this series balast circuit.

Advantages of the circuit according to this invention include a reduction of the blackening of the burners of the discharge valve thus prolonging their life, saving of electric power particularly during ignition of the discharge valve, high reliability of operation, simplicity of construction and low cost.

DESCRIPTION OF THE DRAWINGS

The invention will be described in more detail with reference to an examplary embodiment shown in the attached drawings where.

DESCRIPTION OF THE PREFERRED EMBODIMENT

The circuit connected in series to a discharge valve source comprises a discharge valve V, in this case a discharge valve RVI-400 W, connected in series with an inductor L. A starting capacitor $C_1$, having a capacity of 0.30 uF, is connected in series with the inductor L. In parallel with the inductor L, resonance inductor-capacitor $C_2$ and a control switch A (in this case a RP7 relay) are connected. An ignition capacitor $C_4$, having a capacity of 2 uF, is series-connected to a switching element SP and thyristor T and these are connected in parallel with the discharge valve V. Also connected in parallel with discharge valve V is a resonance discharge valve capacitor $C_3$, the capacity of which is equal to the capacity of the resonance inductor $C_2$. The magnitude of inductance of inductor L, 0.16H, and the magnitude of the capacity of the resonance inductor, capacitor $C_2$, 1 uF, are determined by the resonance frequency of 50 cycles. Pick-up switch B is also connected in parallel with discharge valve V.

Control switch A causes the simultaneous switching of switch elements $a_1$, $a_2$, and $a_3$. Pick-up switch B controls switch elements $b_1$, $b_2$, $b_3$, and $b_4$ which open and close simultaneously with respect to each other. Switch elements of B are connected as follows: $b_1$ is in series with resonance inductor-capacitor $C_2$, $b_2$ is in series with resonance discharge valve capacitor $C_3$, $b_3$ is in series with control switch A, $b_4$ is in series with pick-up switch B.

Switch elements controlled by the control switch A are connected as follows: $a_1$ is in series with pick-up switch B and in parallel with switch element $b_4$, $a_3$ is in series with starting capacitor $C_1$ and parallel to capacitor $C_3$. Switch element $a_2$ is a double switching element connected in series with inductor L.

The circuit operates as follows:

(1) Ignition

After applying the network voltage, the thyristor T opens, and by a resonance of the inductor L and $C_4$ there is formed an ignition voltage on the discharge to V, said voltage causing the ignition. A voltage gradiant on the inductor L triggers control switch A.

(2) Build-up

A switches $a_1$, $a_2$, and $a_3$ and introduces in series with L the build-up capacitor $C_1$ while the thyristor T is off.

After a certain arc voltage has been achieved on the discharge tube, the pick-up switch B is triggered.

(3) Operation

B switches switch elements $b_1$, $b_2$, $b_3$, and $b_4$ and $a_1$, $a_2$, and $a_3$ return to their initial positions. This introduces into the circuit the resonant inductor-capacitor $C_2$ while the build-up capacitor $C_1$ is parallel-connected to the network. The current is thus regulated to its nominal value.

Figure 1:
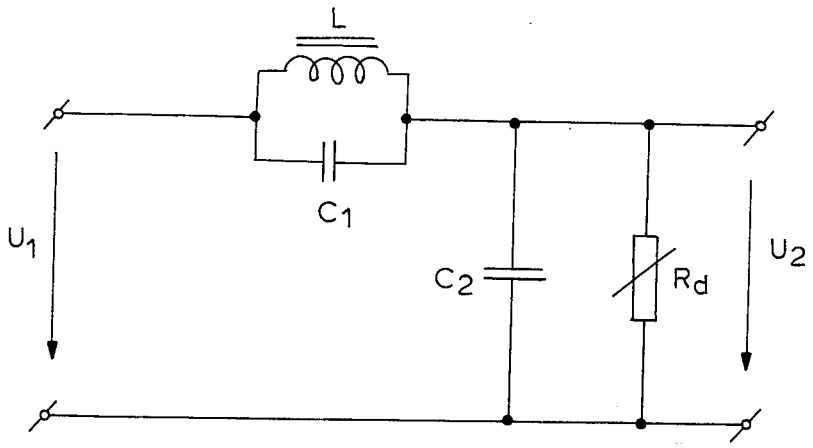
FIG. 1 is a circuit diagram.
Figure 2:
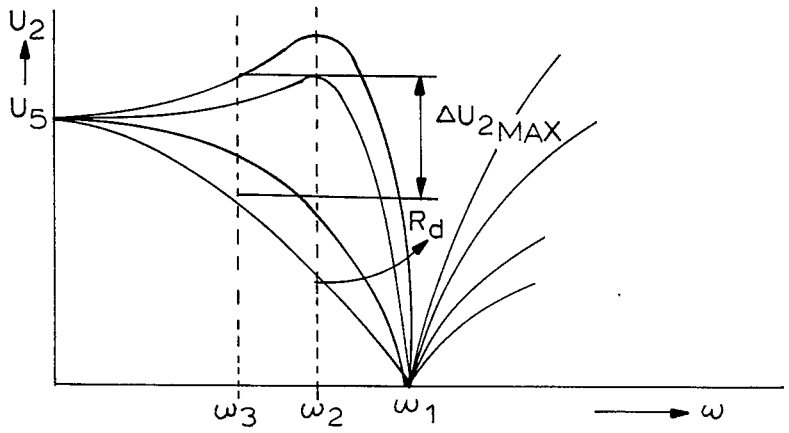
FIG. 2 is a diagram of amplitude frequency characteristics.
Figure 3:
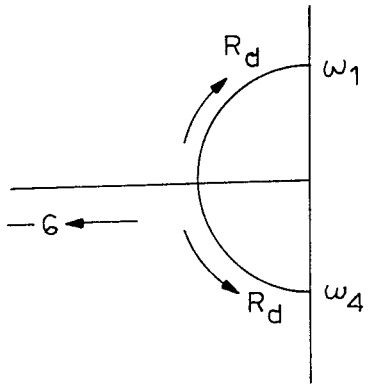
FIG. 3 is a diagram of root hodographs.
Figure 4:
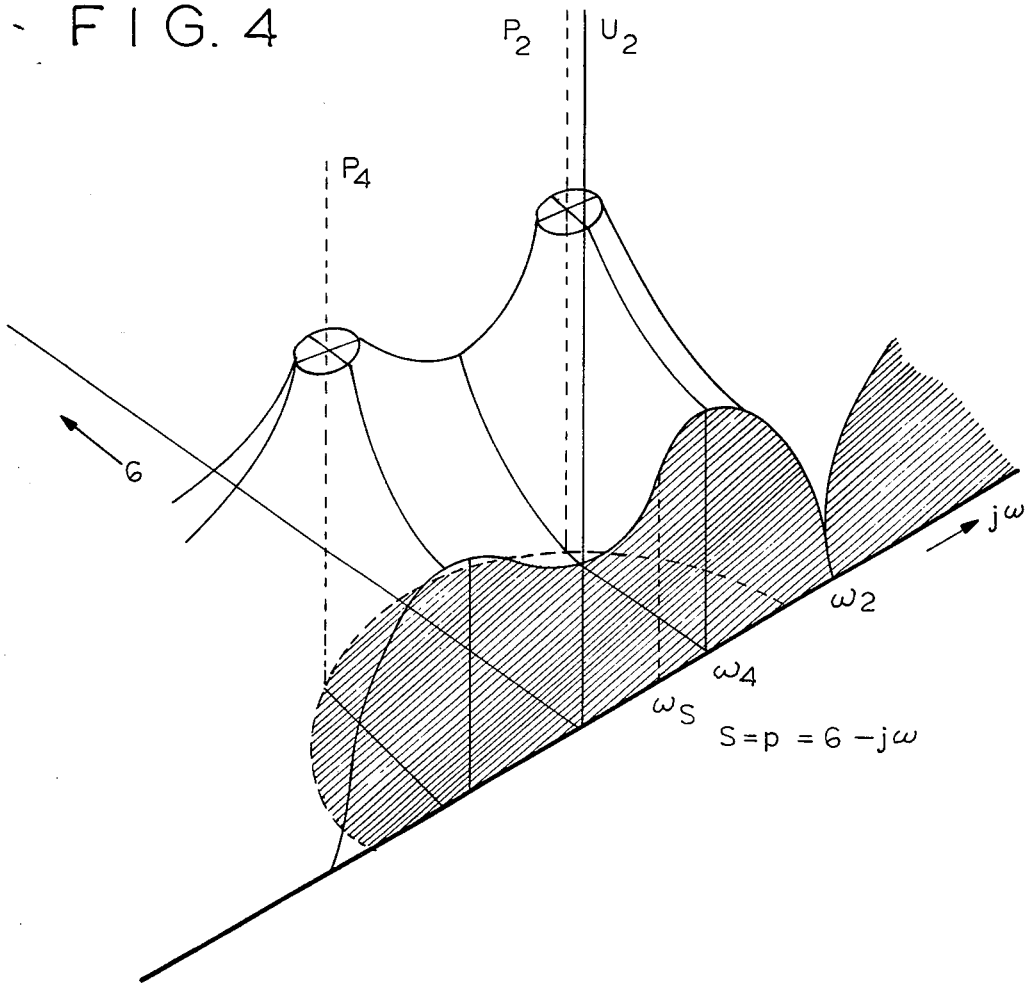
FIG. 4 is a diagram of amplitude function of $U_2$ in dependence on the parameter p.

It results from the above explained operation of the claimed circuit that the ratio of the capacity values ($C_2$:$C_3$) varies between 3:2 and 4:1. This ratio depends on the dynamic resistance of the discharge tube and fluorescent lamp respectively. With the latter, the wiring can be simplified by omitting capacitors $C_1$ and $C_4$ together with all the switch elements so that the circuit will be operated as shown in FIG. 1, i.e. by means of a conventional starter. Values for orientation are $C_2=4$ MF, $C_1=1$ MF for $L=1$ mH. With the discharge tube the capacities $C_1$ and $C_2$ are approximately 10 times higher.

Figure 7:
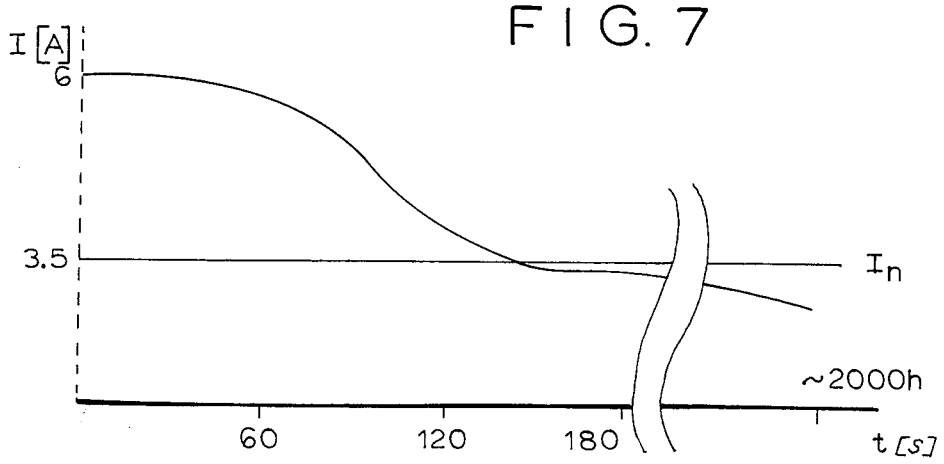
FIG. 7 is a graph of the current of the discharge valve.
Figure 5:
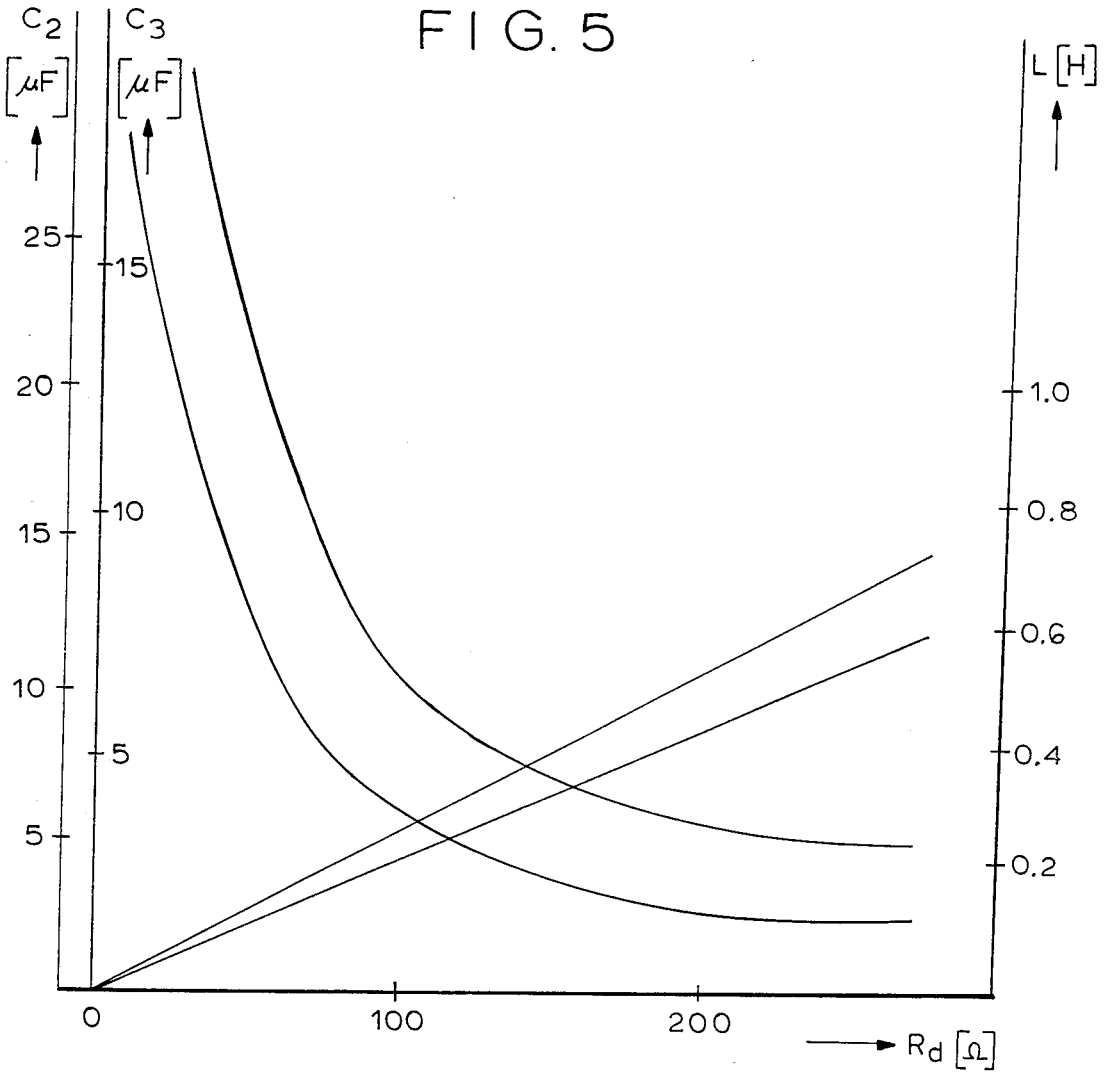
FIG. 5 is a nomogram for determining values L, $C_2$, and $C_3$
Figure 6:
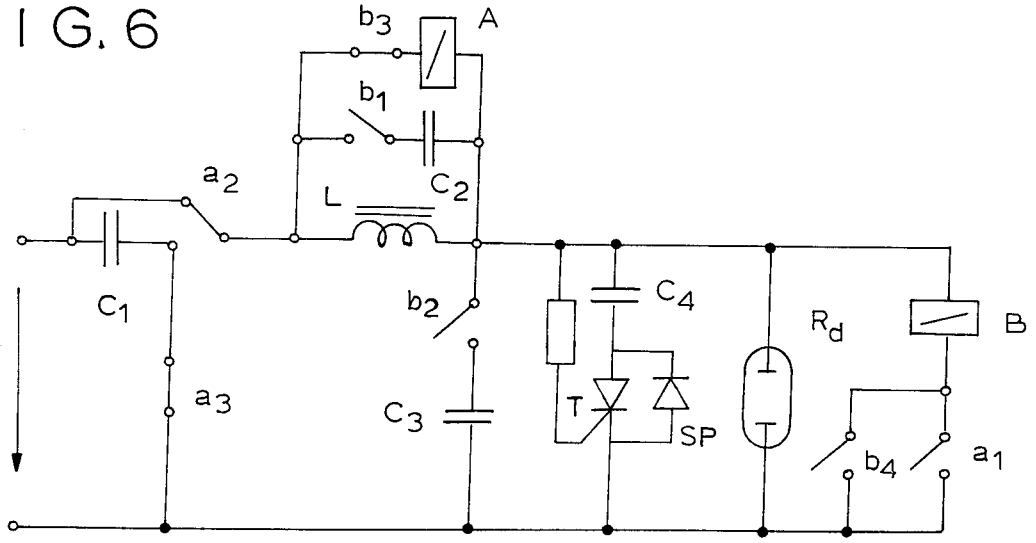
FIG. 6 is a circuit diagram with switches in starting position.

FIG. 7 shows change in the current for the discharge valve RVI-400 W with the circuit according to this invention ($I_n$) and in comparison thereto the current course with a choke coil and a compensating capacitor circuit.

With the choke coil and compensating capacitor circuit the starting current rises generally to 130 to 180% of nominal current. For longer periods, for instance within the range of 2000 hours of operation, the current drops, on the average, to 70% of the nominal current, the luminous intensity of the discharge valve is more quickly reduced due to blackening of burner walls due to the high starting current.

The starting current of the circuit according to this invention does not surpass the value of the nominal current. As the time surpasses 180 seconds, the regulation phase starts, during which the current is regulated to the value of the nominal current. Due to this value of the starting current, which is practically equal to the nominal current, substantially lower wear of the electrodes takes place and thus also a slowing down of the blackening process of the burner walls. This substantially prolongs the life of the discharge valve.

We claim:

1. A circuit connected in series with a discharge valve source having an inductor connected in series with a discharge valve and a starting capacitor connected in parallel to the voltage source for compensation of the power factor, characterized in that the circuit further comprises a reasonance inductor capacitor connected in parallel to the inductor, and a resonance discharge valve capacitor connected in parallel to the discharge valve, the ratio of the capacity of the resonance inductor capacitor to the capacity of the resonance discharge valve capacitor being between 3:2 and 4:1 and the magnitude of the inductance of the inductor and the magnitude of the capacity of the resonance inductor capacitor being determined by the resonant frequency within the range of 30 to 150 cycles.

2. A circuit as claimed in claim 1, further comprising an ignition capacitor connected in parallel to the discharge valve, and a switching element connected in series to said capacitor.

3. A circuit as claimed in claim 2 wherein said switching element is a thyristor.

4. A circuit as claimed in claim 1 which further comprises a pick-up switch connected in parallel to the discharge valve, and a control switch connected in parallel with the resonance inductor, the opening and closing contacts of the pick-up switch being connected in series with the resonance inductor capacitor, in series with the resonance discharge valve capacitor, in series with the control switch and in series with the pick-up switch, while the opening and closing contacts of the control switch are connected in series with the pick-up switch, in parallel with one of the contacts of the pick-up switch, and also in series with the starting capacitor; a change-over contact of the control switch being connected in series with the inductor.

* * * * *